US006945883B1

(12) United States Patent
Williams et al.

(10) Patent No.: US 6,945,883 B1
(45) **Date of Patent: *Sep. 20, 2005**

(54) BASEBALL PITCHER'S TRAINING DEVICE

(76) Inventors: Mark F. Williams, 945 Tennis Ave., Maple Glen, PA (US) 19002; Eric A. Williams, 945 Tennis Ave., Maple Glen, PA (US) 19002

( * ) Notice: Subject to any disclaimer, the term of this patent is extended or adjusted under 35 U.S.C. 154(b) by 7 days.

This patent is subject to a terminal disclaimer.

(21) Appl. No.: 10/747,099

(22) Filed: Dec. 30, 2003

(51) Int. Cl.[7] ..... A63B 69/00; A63B 71/00
(52) U.S. Cl. ..... 473/452; 473/422; 473/497
(58) Field of Search ..... 473/422, 451, 473/452, 150, 497–501, 225; 482/19; 434/252

(56) References Cited

U.S. PATENT DOCUMENTS 3,236,520 A * 2/1966 Friedman ..... 473/452
3,244,421 A * 4/1966 Hanna ..... 473/273
4,516,772 A * 5/1985 Stratton ..... 473/452
5,385,343 A * 1/1995 Davis, Sr. ..... 473/452
6,139,450 A * 10/2000 Rivers ..... 473/422
6,500,078 B1 * 12/2002 Williams et al. ..... 473/452
6,843,739 B2 * 1/2005 Putnam ..... 473/497

* cited by examiner

*Primary Examiner*—Mitra Aryanpour
(74) *Attorney, Agent, or Firm*—C. J. Husar, Esq.

(57) ABSTRACT

A baseball pitcher's training device for training a pitcher in controlling his body mechanics during the pitch preparation phase as well as the delivery and follow-through phases of baseball pitching. The training device includes a collapsible balance beam that can readily be shortened to improve its portability, shipping and storage and is adjustable in length to accommodate users of different height. The device is also provided with a removable mound that is tapered in a forward direction to give the user a feeling of actual mound use when positioned thereon.

24 Claims, 3 Drawing Sheets

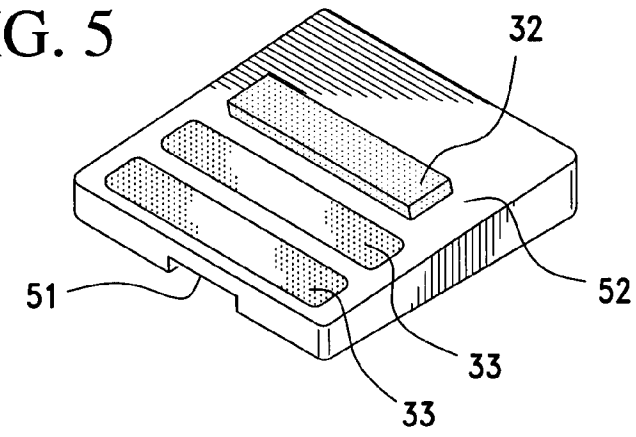
FIG. 5
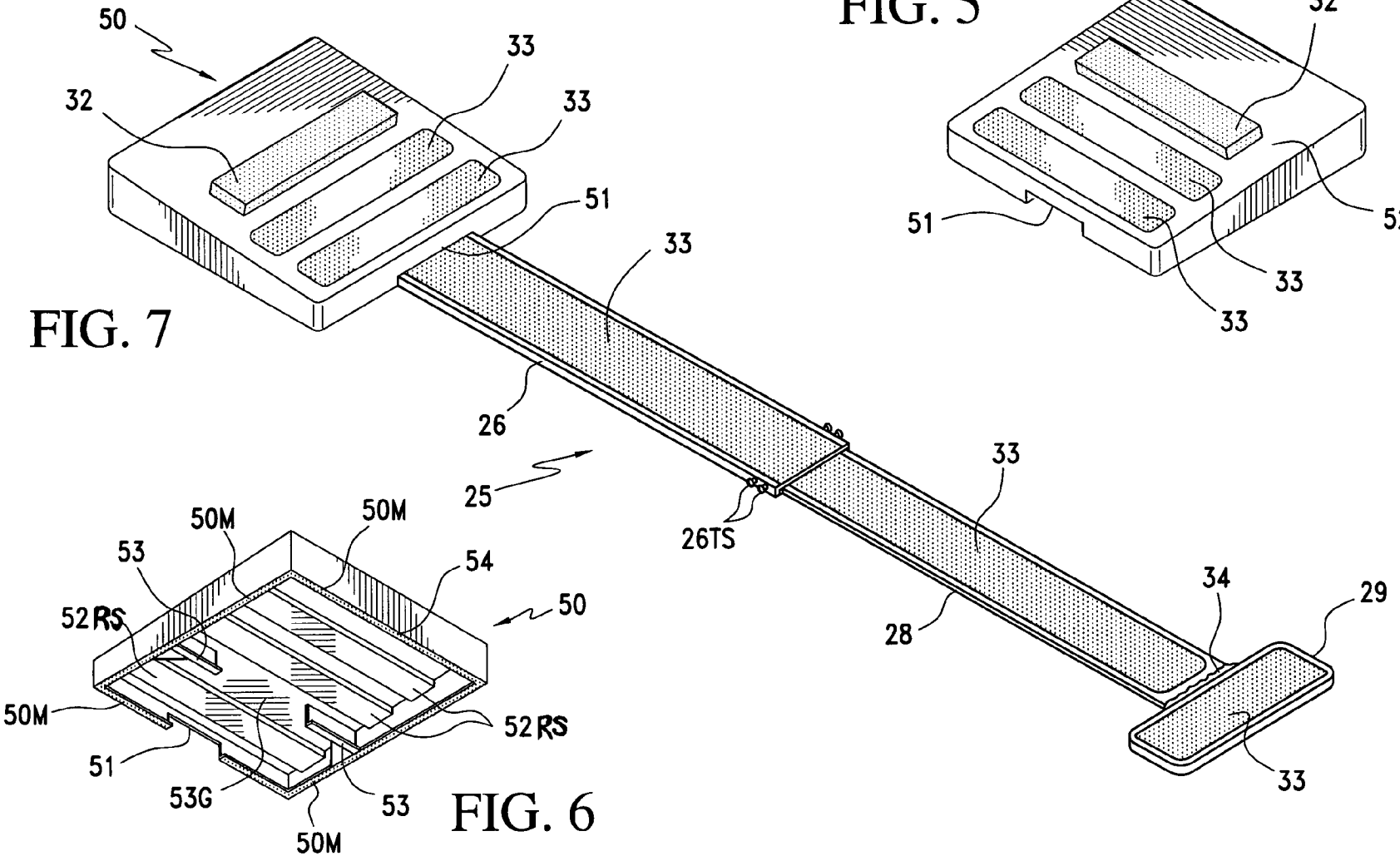
FIG. 6
FIG. 7

BASEBALL PITCHER'S TRAINING DEVICE

CROSS REFERENCE TO RELATED APPLICATIONS

The present invention is closely related to Ser. No. 09/923,365 issued as U.S. Pat. No. 6,500,078 on Dec. 31, 2002 to Williams et al, inventors of the subject application.

BACKGROUND OF THE INVENTION

The present invention is directed to the same subject matter as the above-identified patent, i.e. a device for improving a baseball pitcher's delivery of a baseball, whether it be from the "stretch" position or from the "full wind-up" position. It has been found that practice is key to most endeavors, and the observation most certainly applies to baseball pitching. The mechanical routine that a pitcher goes through prior to the "game time" delivery of a ball to the catcher helps the pitcher build his skill and confidence that the ball will end up exactly where he wants. Delivery of the ball, whether it be high and inside, low and outside or right down the middle is based upon refined pitching mechanics. There is a lot of truth to the old adage that "practice makes perfect". The merits and advantages of repeated use of the subject training device are clearly set forth in great detail in U.S. Pat. No. 6,500,078, the entire disclosure of which is hereby incorporated herein by reference. Therefore, it is with that thought in mind that applicant continues to try and refine the equipment that will train a baseball pitcher to be the best that he can be.

SUMMARY OF THE INVENTION

Since issuance of the above noted patent, it has been found that there are several areas that require attention to improve the overall acceptability and usefulness of the device. For example, it has been found that the overall length of the training device was too long to be conveniently transported in the trunk of most vehicles, thus applicant's have developed a telescopic beam feature that divides the unit in approximately half, allowing for convenient transport in the trunk of a vehicle, as well as product shipment and storage. This collapsible feature, wherein one portion of the balance beam is telescopically received in the other, in addition to allowing easier transport in a vehicle, product shipment and storage, also allows for the linear adjustment of the device to compensate for differences in height of various users.

Additionally, the mound has been modified, i.e. it has been provided with a forward, downward taper to provide the user with the sloped feeling of an actual mound. Further, the main elongated member forming the balance beam portion has been reduced in height, to give the user a more realistic feeling of "being on the ground", when, in fact, he is slightly elevated on the balance beam. Additionally, the lower beam height also reduces the potential for ankle related injuries that are more likely on the previously patented elevated beam. As in the earlier model, the present invention includes the usual abutment block or "rubber" which is used to locate the user's back foot during the various stages of the pitching procedure. Further, the improved unit includes a strategically located wider foot supporting area with friction surfaces to insure that the user does not lose his initial footing when going through the steps of delivery.

OBJECTS OF THE INVENTION

An object of the invention is to provide a baseball pitcher's training device that is portable and can readily be moved from place to place.

Another object of the invention is to provide a baseball pitcher's training device that is telescopic which will longitudinally retract allowing for easy transport in most vehicle trunks, product shipment and storage.

A further object of the invention is to provide a baseball pitcher's training device that includes a forward, downward taper, simulating a ball park mound.

A still further object of the invention is to provide a baseball pitcher's training device that is longitudinally adjustable to compensate for users of different stride length, which is based on the pitcher's height.

Yet another object of the invention is to provide a baseball pitcher's training device wherein the mound is removable from the balance beam portion to accommodate practice from the "stretch" position, or from the "full wind-up" position.

These and other objects of the invention will become more apparent hereinafter. The instant invention will now be described with reference to the accompanying drawings wherein like reference characters designate the corresponding parts throughout the several views.

BRIEF DESCRIPTION OF THE DRAWINGS

FIG. 5 is a perspective view of an optional enlarged mound pitching platform per se.

FIG. 6 is a bottom view of enlarged pitching mound platform 50 illustrating several reinforcement strips 52RS that provide additional strength and rigidity to mound 50. A pair of projecting wall portions 53 extend inwardly toward each other leaving a gap 53G therebetween for receiving first elongate member 26 therebetween. Wall portions 53 and rear wall 54 provide a receptacle area for receiving foot supporting area 27 therein to stabilize mound 50 when placed thereover. Additionally, all ground engaging bottom wall surfaces are provided with a rubberized membrane 50M applied to these surfaces to help prevent slippage during usage and also help protect the floor surface when used indoors.

FIG. 7 is another isometric view, similar to FIG. 1, with the enlarged mound pitching platform mounted thereon.

DETAILED DESCRIPTION OF THE DRAWINGS

Figure 1:
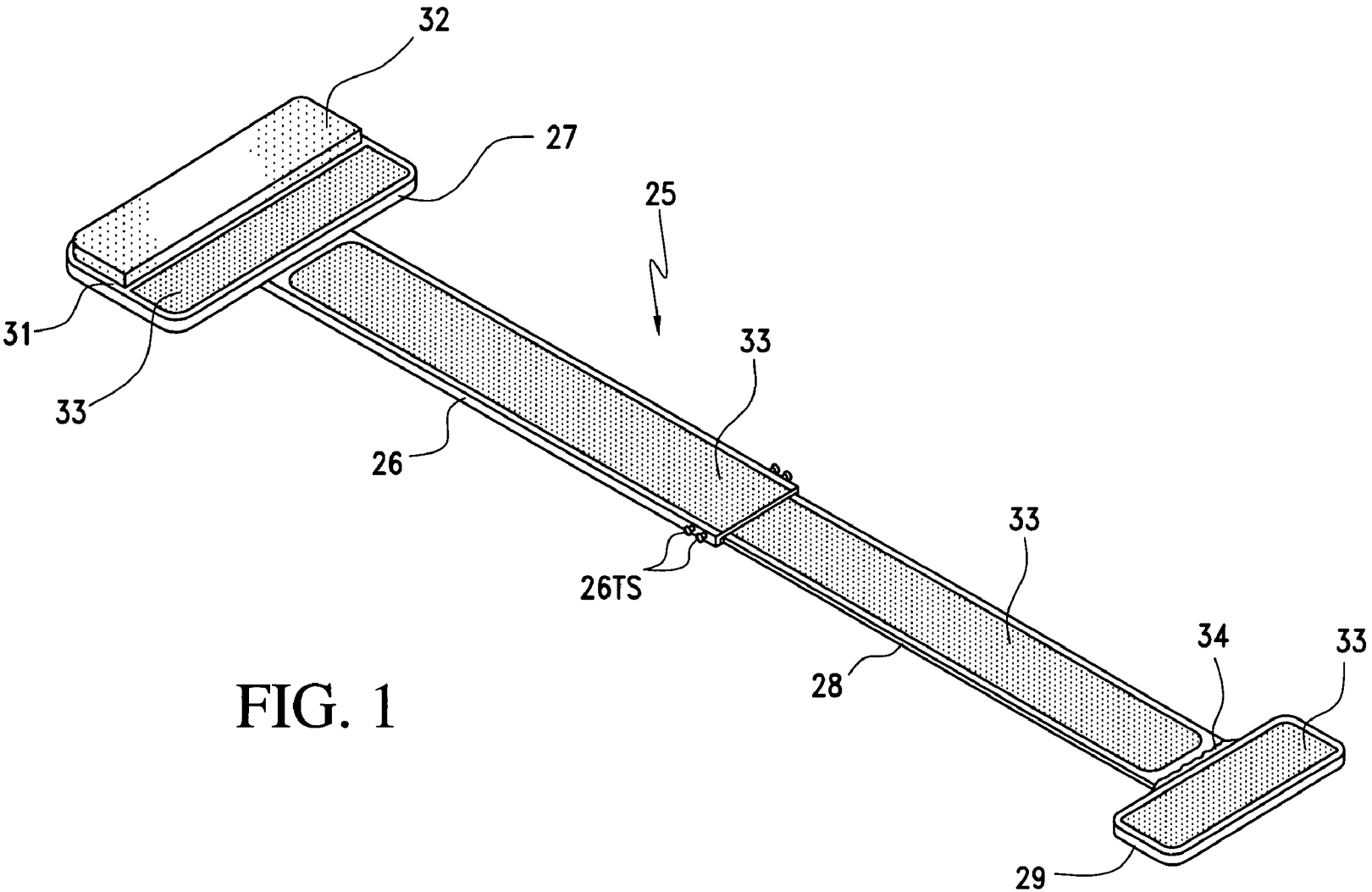
FIG. 1 is an isometric view of the telescopic beam training device in its fully extended position.

Referring now to FIG. 1, there is shown an isometric view of the pitcher's training device 25. As shown, training device 25 includes a first elongated tube-like portion 26 that is attached to a foot supporting area 27 at one end thereof and receives second elongated portion 28 therein at its opposite terminal end. Second elongated portion 28 is telescopically received within first elongated tube-like portion 26 and is secured in its desired longitudinal position by a plurality of thumb screws 26TS that engage the opposite sides of second elongated portion 28 when threaded clockwise to hold second elongated portion 28 in its desired position. The free end of second elongated portion 28 is provided with a forward support member 29 that is secured thereto perpendicular to the longitudinal axis of the elongated members 26 and 28 and provides stability to training device 25 when in use. As shown, there is a weld bead 34 for attaching forward support member 29 to second elongated portion 28.

Foot supporting area 27 is mounted perpendicular to first and second elongated portions 26 and 28, respectively, with the width dimension of foot supporting area 27 totally overlapping the free end of first elongated portion 26. The upper surface 31 of foot supporting area 27 includes the usual pitcher's foot abutment block or "rubber" 32 that the pitcher places his foot against in the pitching process. Positioned adjacent to rubber 32 is a parallel strip of friction material 33 with additional strips 33 of anti-slip tape on first and second elongated portions 26 and 28 to provide the user with a slip resistant surface when in his initial stance position and when landing his foot thereon during delivery of the ball.

Figure 2:
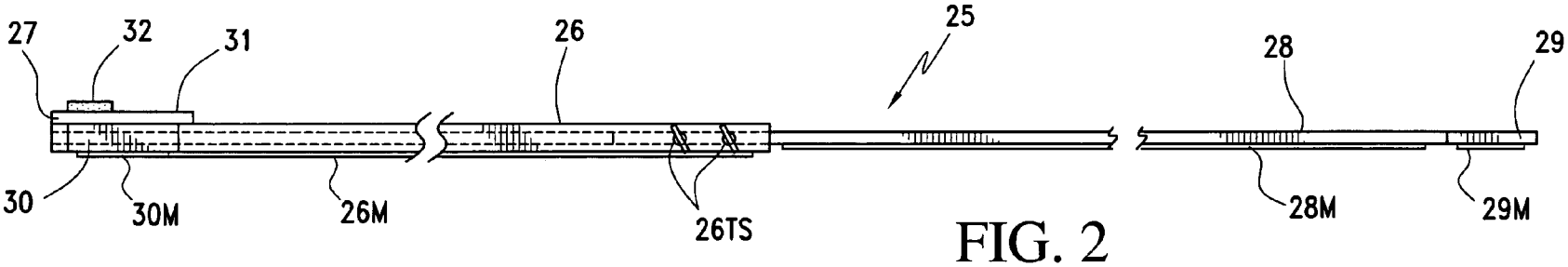
FIG. 2 is a side view of the telescopic beam training device shown in FIG. 1, in its fully extended position.

FIG. 2 is a side view of the training device illustrated in FIG. 1 with second elongated portion 28 in its fully extended position relative to first elongated portion 26 and secured by a pair of thumb screws 26TS. As indicated earlier, the training device 25 is longitudinally adjustable to accommodate pitchers of different height with different strides and also provide a device that can be readily collapsed for transporting purposes in a vehicle trunk or other limited space area, product shipment and storage. It is to be noted that the undersurface of members 26, 28, 29, and 30 are each provided with a rubberized membrane applied thereto to help prevent slippage during usage and also help protect the floor when used indoors, for example, a gymnasium.

Figure 3:
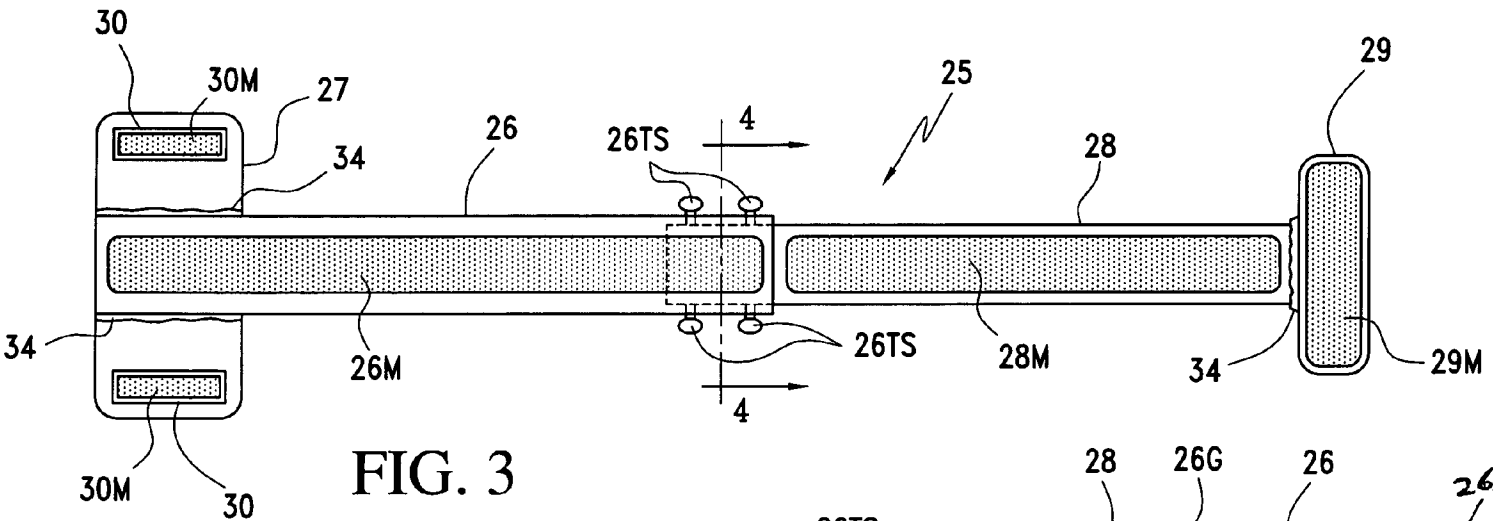
FIG. 3 is a bottom view of the unit shown in FIGS. 1 and 2 illustrating the manner of attachment of the foot supporting area and forward support member.

FIG. 3 is a bottom view of training device 25 shown in FIGS. 1 and 2 illustrating the interconnection of foot supporting area 27 and forward support member 29 to their respective elongated members 26 and 28 by weld beads 34. Additionally, there is shown a pair of spaced supporting feet 30 attached to the undersurface of foot supporting area 27. Also, weld beads 34 are clearly shown on opposite sides of first elongated member 26 for attaching foot supporting area 27 thereto. Again, it can be clearly seen that each of members 26, 28, 29, and 30 is provided with a rubberized membrane applied to each of these components and designated, 26M, 28M, 29M, and 30M, respectively. The purpose of this membrane coating is to help prevent slippage during usage and also help protect the floor surface when used indoors.

Figure 4:
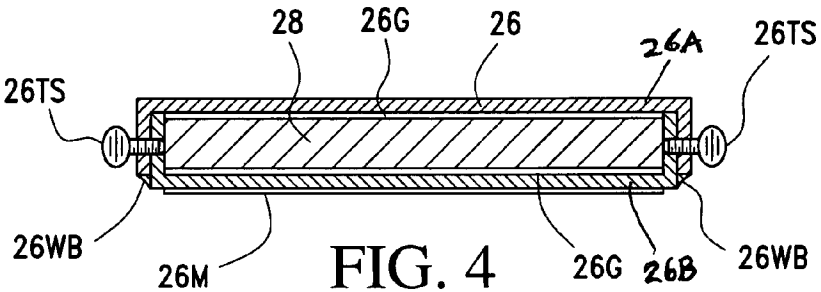
FIG. 4 is a sectional view taken along the plane 4—4 of FIG. 2 illustrating the telescopic relationship of both the first and second elongated members.

FIG. 4 is a sectional view taken along the plane 4—4 in FIG. 2 and clearly illustrates how first elongated portion 26 is constructed. As shown, first elongated portion 26 is formed by two U-shaped members 26A and 26B with their open portions facing each other that are joined together as by a pair of oppositely disposed weld beads 26WB to form the tube-like enclosure for receiving second elongated member 28. It should be noted that there is a gap 26G, providing sufficient internal clearance between first elongate member 26 and second elongate member 28 to allow resistant free movement of second elongate member 28 relative to first elongated portion 26 when adjustments are made to accommodate users of different height. Although first elongated portion 26 is shown as a two-component member with weld beads 26WB securing the components 26A and 26B together to form the tube-like receiver portion for receiving second elongated portion 28, this is merely an exemplary construction and other configurations are possible, at a minimum, second elongate member 28 should be partially encompassed by and received within first elongate member 26 and provide support thereto.

FIG. 5 is an illustration of an enlarged mound pitching platform 50 per se, this is an optional addition to the pitchers training device 25 illustrated in FIGS. 1–3. Enlarged pitching mound platform 50 is used by lesser experienced pitchers when a pitcher is pitching from the "full wind-up" position. Its use with the pitcher's training device 25 is described in more detail with respect to FIG. 7 hereinafter. As shown, enlarged mound 50 is basically a rectangular member with a central cut-out 51 for receiving first elongate member 26. Upper surface 52 is provided with a plurality of strips 33 of anti-slip tape and also abutment block or "rubber" 32 with a forward, downward taper to give the user a more realistic feeling of actual "mound" use on a playing field.

FIG. 6 is a bottom view of enlarged pitching mound platform 50 illustrating several reinforcement strips 52 that provide additional strength and rigidity to mound 50. A pair of projecting wall portions 53 extend inwardly toward each other leaving a gap 53G therebetween for receiving first elongate member 26 therebetween. Wall portions 53 and rear wall 54 provide a receptacle area for receiving foot supporting area 27 therein to stabilize mound 50 when placed thereover. Additionally, all ground engaging bottom wall surfaces are provided with a rubberized membrane 50M applied to these surfaces to help prevent slippage during usage and also help protect the floor surface when used indoors.

Turning now to FIG. 7, there is shown a pitcher training device 25 with enlarged mound pitching platform 50 positioned over foot supporting area 27. This is for use in the "full wind-up" position. It has been found that the foot supporting area 27 of FIG. 1, can be somewhat intimidating for very young pitchers, therefore, the enlarged mound platform 50 is utilized until the user has developed sufficient skill and confidence in its use. The enlarged mound platform 50 is removable to allow the player to practice pitching mechanics from the "full wind-up" or "stretch" positions.

By way of review, it should be noted that pitcher's training device 25 can be made in a variety of ways. For example, balance beam members 26 and 27 could be made of extruded aluminum or an appropriate gauge of sheet metal with rolled over edges. Enlarged mound 50 could similarly made of galvanized sheet metal that readily resists oxidation and allows modern bending fabrication techniques and methods.

While the invention has been described in its preferred embodiment, it is to be understood that the words which have been used are words of description rather than words of limitation and that changes may be made within the purview of the appended claims without departing from the full scope or spirit of the invention. Accordingly, the present invention is to be limited only by the appended claims, and not by the foregoing specification.

Having thus described our invention, we claim:

1. A baseball pitcher's training device for training a pitcher to maintain proper control of his upper and lower body portions prior to and during delivery of a baseball pitch, said training device comprising:

an elongated balance beam including a first portion of a particular thickness and width and a second portion of slightly less width operably connected to said first portion;

a first foot supporting means connected to one end of said first portion of said balance beam;

said first foot supporting means perpendicularly disposed relative to said one end of said balance beam;

said second portion of said balance beam including a cross-member secured to the end remote from the end received by said first portion of said balance beam;

said first foot supporting means having a flat surface and including a pitching rubber attached to said flat surface thereof; and friction increasing means attached to the upper and lower surfaces said first foot supporting means, said first and second portions of said balance beam and said cross-member;

said first foot supporting means and said balance beam providing support for a pitcher's feet when executing delivery of a baseball.

2. A baseball pitcher's training device as defined in claim 1 wherein said second portion of said elongated beam is telescopically received in said first portion when it is desired to transport, package or store the device.

3. A baseball pitcher's training device as defined in claim 1 wherein said first and second elongated portions of said balance beam includes means for locking said first and second portions in a desired position whereby the length of said balance beam can be varied to accommodate pitchers of different height.

4. A baseball pitcher's training device as defined in claim 1 wherein said first foot supporting area has a given length and width dimension and said width dimension joins a surface of said one end of said first portion of said elongated balance beam.

5. A baseball pitcher's training device as defined in claim 1 wherein said rubber serves as a foot abutment for a pitcher during pitching.

6. A baseball pitcher's training device as defined in claim 1 wherein said first foot supporting area is provided with supports to improve the stability of the training device.

7. A baseball pitcher's training device as defined in claim 1 wherein said elongated balance beam is made of extruded aluminum without an exterior finish.

8. A baseball pitcher's training device as defined in claim 1 wherein said elongated balance beam is made of extruded aluminum with an exterior finish.

9. A baseball pitcher's training device as defined in claim 1 wherein said elongated balance beam is made of fiberglass.

10. A baseball pitcher's training device as defined in claim 1 wherein said elongated balance beam is made of any suitable plastic material.

11. A baseball pitcher's training device as defined in claim 1 wherein said elongated balance beam is made of any rigid metal without an exterior finish.

12. A baseball pitcher's training device as defined in claim 1 wherein said elongated balance beam is made of any rigid metal with an exterior finish.

13. A baseball pitcher's training device as defined in claim 1 wherein said friction reducing surfaces are strips of anti-slip surfacing.

14. A baseball pitcher's training device as defined in claim 1 wherein said first foot supporting means includes an enlarged mound area that is placed over said first foot supporting means for use by a pitcher when pitching from the full wind-up position.

15. A baseball pitcher's training device as defined in claim 1 wherein said enlarged mound has a surface which is tapered forward to give the user a feeling of actual mound use when pitching therefrom.

16. A baseball pitcher's training device as defined in claim 14 wherein said enlarged mound is made of aluminum with an exterior finish.

17. A baseball pitcher's training device as defined in claim 14 wherein said enlarged mound is made of aluminum without an exterior finish.

18. A baseball pitcher's training device as defined in claim 14 wherein said enlarged mound is made of steel without an exterior finish.

19. A baseball pitcher's training device as defined in claim 14 wherein said enlarged mound is made of steel with an exterior finish.

20. A baseball pitcher's training device as defined in claim 14 wherein said enlarged mound is made of fiberglass without an exterior finish.

21. A baseball pitcher's training device as defined in claim 14 wherein said enlarged mound is made of fiberglass with an exterior finish.

22. A baseball pitcher's training device as defined in claim 14 wherein said enlarged mound is made of any suitable plastic with an exterior finish.

23. A baseball pitcher's training device as defined in claim 14 wherein said enlarged mound is made of any suitable plastic without an exterior finish.

24. A baseball pitcher's training device as defined in claim 15 wherein said upper surface includes a rubber abutment block and anti-slip surfacing to reduce slippage by the user.

* * * * *